US005132698A

United States Patent [19]

Swineford

[11] Patent Number: 5,132,698

[45] Date of Patent: Jul. 21, 1992

[54] CHOKE-SLOT GROUND PLANE AND ANTENNA SYSTEM

[75] Inventor: Kevin D. Swineford, Canoga Park, Calif.

[73] Assignee: TRW Inc., Redondo Beach, Calif.

[21] Appl. No.: 750,144

[22] Filed: Aug. 26, 1991

[51] Int. Cl.[5] ..... H01Q 1/48

[52] U.S. Cl. ..... 343/846; 343/829; 343/DIG. 2

[58] Field of Search ..... 343/829, 830, 846, DIG. 2

[56] References Cited

U.S. PATENT DOCUMENTS

| | | | |
|---|---|---|---|
| 4,700,197 | 10/1987 | Milne | 343/846 |
| 4,788,550 | 11/1988 | Chadima | 343/829 |
| 4,851,859 | 7/1989 | Rappaport | 343/846 |
| 4,864,320 | 9/1989 | Munson et al. | 343/846 |

OTHER PUBLICATIONS

R. E. Lawrie et al., "Modifications of Horn Antennas for Low Sidelobe Levels," IEEE Trans. Antennas Propagat., vol. AP-14, pp. 605-610, Sep. 1966.

*Primary Examiner*—John D. Lee
*Assistant Examiner*—Robert E. Wise
*Attorney, Agent, or Firm*—G. Gregory Schivley; Ronald L. Taylor

[57] ABSTRACT

A choke-slot ground plane and antenna system 30 is disclosed. In one embodiment the choke-slot ground plane and antenna system 30 includes a monopole antenna 44, a ground plate 36 having a plurality of concentric annular grooves 38*a-c*. Other embodiments include a ground plane 36 having varying size grooves to 38*a-l*, a ground plane having grooves having filled with dielectric material 38*a'-c'*, a ground plate having a broadened bandwidth and having a series of first and second-type grooves 34*a-c* and 38*a''-c''*, and a ground plate having a frusto-conical shape 36*a* and 36*b*.

17 Claims, 4 Drawing Sheets

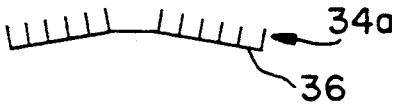
FIG. 7A
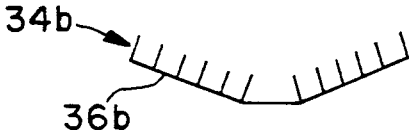
FIG. 7B
FIG. 8A
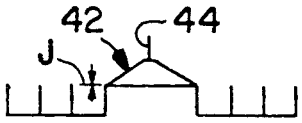
FIG. 8B
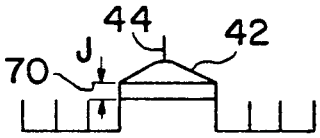
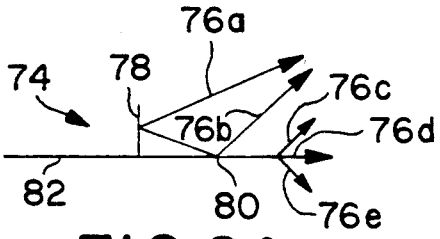
FIG. 9A
PRIOR ART
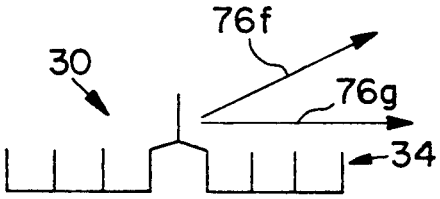
FIG. 9B
FIG. 12
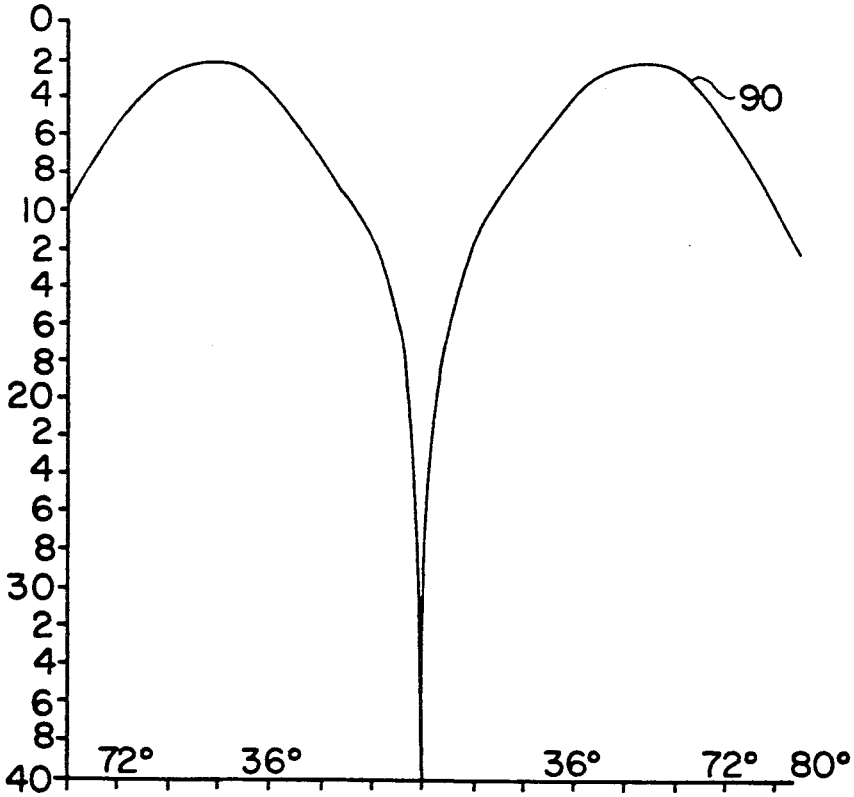

CHOKE-SLOT GROUND PLANE AND ANTENNA SYSTEM

BACKGROUND AND SUMMARY OF THE INVENTION

The present invention relates generally to a ground plane and antenna system, and more specifically, to a choke-slot ground plane and monopole antenna system.

Monopole antennas are one of the simplest forms of antennas having a single radiating element. The conventional monopole antenna is typically an electrically small antenna, which has physically small or compact dimensions. The monopole operating without a ground plane produces a substantially toroidal radiation pattern. In contrast, the monopole antenna having a ground plane produces a toroidal radiation pattern which is sliced horizontally in the direction of the surface of the ground plane. A monopole antenna with a ground plane is commonly used for long range communications, commercial broadcasting, and mobile communications.

Ideally, the monopole antenna with an infinite ground plane, in combination, produces a smooth half-toroidal radiation pattern. In practice, antennas of this type have finite ground planes which produce a radiation pattern that is uneven, scalloped and has electrical radiation below the ground plane. The scalloped pattern generated by the conventional ground plane and monopole antenna systems may vary erratically, result in a loss of gain, and experience excess spurious energy losses. In some applications, suppression of the radiation pattern below the ground plane is crucial. For example, a military jamming device radiating large amounts of power requires that the amplifying transmitter is isolated from the radiation of the antenna in order to prevent interference. In present day high power jammers, isolation levels of 120 dB are usually required. Conventional monopole antennas having a ground plane are ineffective in this application due to the spurious energy radiated below the ground plane. Additional and expensive isolation equipment is required to isolate the transmitting section from the spurious energy.

For mobile communications in the continental United States, the monopole antenna should have a high sensitivity for satellites in geosynchronous orbit. A candidate antenna for this type of communication should have a radiation pattern with a peak in sensitivity at about 45° above the horizon. Conventional monopole antennas having a ground plane may have to be moved or scanned in order to find the peak sensitivity, which may occur at measured angles of 18° above the horizon. The uncertain and scalloped nature of the conventional monopole antenna having a ground plane yields uncertainty as to whether poor communication is due to external interference or simple problems such as antenna alignment.

What is needed is a monopole antenna and ground plane configuration which yields a smooth radiation pattern having a high pointing angle and a high isolation from spurious radiation energy below the ground plane.

The preferred embodiments of the invention disclose an antenna system having a monopole antenna, a ground plate with a plurality of concentric annular grooves, and an adjustable feed section for movably attaching the monopole to the ground plate.

A second embodiment of the invention discloses an antenna system having a monopole antenna, a ground plate with a plurality of grooves filled with a dielectric material, and an adjustable feed section. The second embodiment yields a ground plate which is smaller in size than the comparable ground plate without dielectric material.

A third embodiment of the invention discloses a choke-slot ground plane and antenna system in which the ground plate has a frusto-conical shape. The frusto-conical shape of the ground plate is useful for allowing a different range or 'window' of available angles of peak sensitivity which can vary as a function of the height of the adjustable feed section.

BRIEF DESCRIPTION OF THE DRAWINGS

The various advantages of the present invention will become apparent to those skilled in the art after a study of the following specification and by reference to the drawings in which:

FIGS. 7*a* and 7*b* are schematical cross-sectional views showing a frusto-conical choke-slot ground plane employed in one embodiment of the present invention;

FIGS. 8*a* and 8*b* are schematical views of the flush and raised positions the adjustable feed section;

FIGS. 9*a* and 9*b* are diagrams showing the principles of operation of a ground plane and monopole antenna system according to the prior art and a choke-slot ground plane and monopole antenna system in accordance with the present invention;

FIG. 12 is a graph showing the radiation pattern of a choke-slot ground plane and monopole antenna system having six chokes and an elevated adjustable feed section.

DESCRIPTION OF THE PREFERRED EMBODIMENTS

It should be understood that the following description of the preferred embodiments is merely exemplary in nature and in no way intended to limit the invention or its application or uses.

Figure 1:
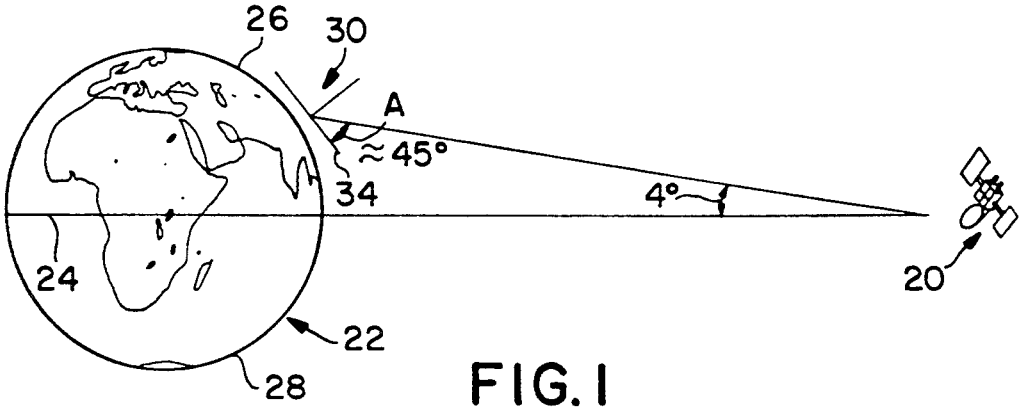
FIG. 1 is a schematical diagram showing the relative positions of the earth, a geosynchronous satellite, and the present invention.

FIG. 1 shows a typical communication scenario. A geosynchronous satellite 20 orbits the earth in a fixed position 22,300 miles above the earth 22 and directly above the equator 24. A choke-slot ground plane and monopole antenna system 30, which is shown schematically and greatly enlarged for purposes of illustration, is typically a downlink in a communications system. The antenna system 30 can be placed in the northern hemisphere 26 or in the southern hemisphere 28. The positioning of the choke-slot ground plane and antenna system will affect the angle A that the antenna makes with the satellite 20. The particular positioning of the choke-slot ground plane and antenna system 30 shown in FIG. 1 makes an angle A of 45° between the horizon or the ground plane 34, and the satellite 20. One skilled in the art would understand that the actual position of the antenna system 30 in either hemisphere will vary the angle between the horizon and the satellite. Therefore, an antenna system 30 that is closer to the equator would require a higher pointing angle and an antenna system which is closer to either of the poles would require a lower pointing angle or a radiation pattern that is peaked near to the horizon.

Figure 2:
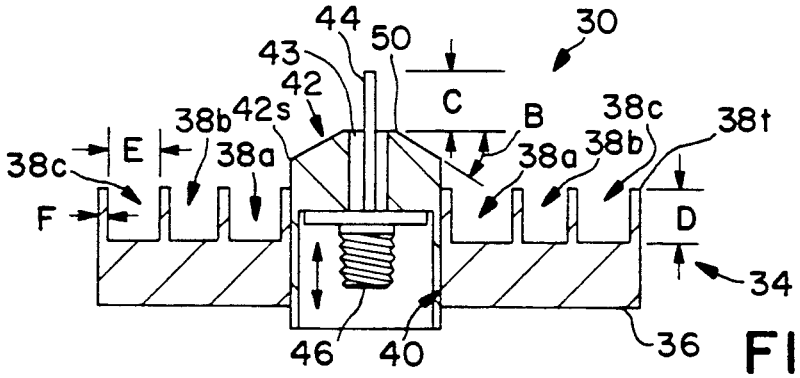
FIG. 2 is a cross-sectional view of a choke-slot ground plane and a monopole antenna system having three grooves in accordance with one embodiment of the present invention.

FIG. 2 shows a choke-slot ground plane and monopole antenna system 30 in accordance with the present invention. The ground plane 34 includes a ground plate 36 made of a conducting material and having closed grooves 38*a–c*. The ground plate 36 contains a central bore 40. An adjustable feed section 42 is used to hold a monopole antenna 44 and may be adjustable within the bore in order to raise or lower the monopole antenna 44. The adjustable feed section 42 provides impedance matching to the monopole antenna. This is accomplished by providing a coupling surface 50 in combination with an unbalanced fed, ¼ wave, resonant antenna 44, which functions as a ½ wave, balanced fed resonant antenna in accordance with basic antenna image theory.

The monopole antenna 44 may be connected to a transmitter by the flange mount jack receptacle 46. Interposed between the monopole antenna 44 and the adjustable feed section 42 is an insulator 43, which prevents the monopole antenna 43 from forming a short with the ground plane 34. A standard simple monopole, a broad band bicone-type monopole, or a circular polarized helix-type monopole would be suitable antennas for use with the present invention.

The adjustable feed section 42 has a angled annular surface 50. The surface 50 makes an angle B. One skilled in the art would understand that angle B can be varied to affect changes in beam pointing angle. The effects of varying angle B are second-order and should not be considered serious radio frequency modifications. However, surface 50 does provide a built-in angle of incidence for the radiated energy as it encounters the ground plane 34, which must be determined empirically.

Figure 3:
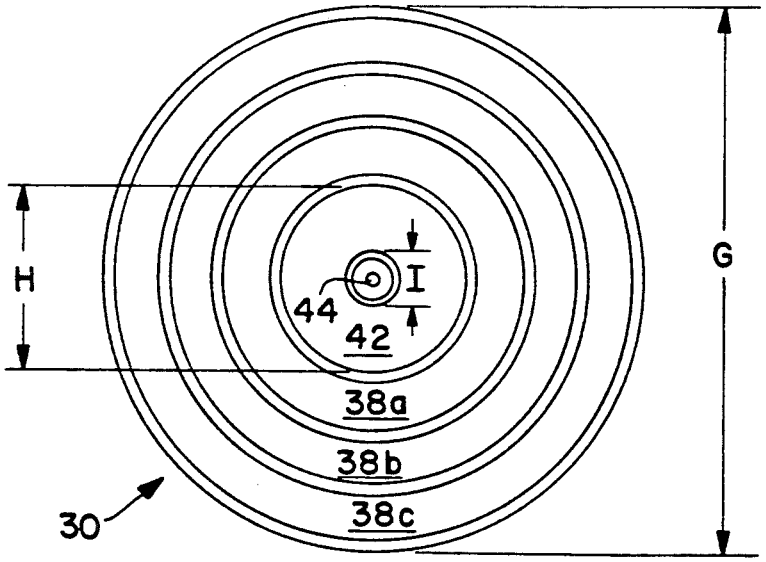
FIG. 3 is a top view of a choke-slot ground plane and monopole antenna system showing the concentric arrangement of the three grooves.

FIG. 3 is a top view of the choke-slot ground plane and antenna system 30. The arrangement of the closed grooves 38*a–c*, and the adjustable feed section 42, are concentric about a common axis defined by the monopole antenna 44. Each groove 38*a–c* forms a choke which is, in effect, a shorted waveguide that produces a highly capacitive impedance over the ground plane 34.

While FIGS. 2 and 3 illustrate a choke-slot ground plane and monopole antenna having a three choke configuration, the present invention is not limited to this configuration. The number of chokes may range from more than one choke to as many as several dozen. The multiple choke configuration increases the smoothness of the radiation pattern with the increasing number of grooves. As a practical matter, a 12 choke configuration having 12 grooves and multiple choke configurations having grooves that number greater than 12 yield a decreasing small benefit and add size and cost per unit manufactured.

Again turning to FIGS. 2 and 3, the dimensions of grooves 38*a–c* are dictated by the operating frequency of the choke-slot ground plane and antenna system. Ideally, a capacitive field occurs on the top plane 38*t*, formed by the top portions of grooves 38*a–c*, on the ground plane 34 during operation. The capacitive field stems from the interaction of waves (not shown for the purposes of illustration) with the grooves 38*a–c* according to transmission line theory. The monopole antenna 44 is typically one quarter of the wavelength of the operating frequency in length. Dimension C is the quarter wavelength dimension for the monopole antenna 44. Grooves 38*a–c* are generally required to have a quarter wavelength depth, as shown in conjunction with the depth dimension D, in order to form the shorted waveguide that produces a highly capacitive impedance. In addition, grooves 38*a–c* have a width dimension E which is a whole fraction of a wavelength. The wall dimension F should be as thin as possible in order to reduce the space requirement of the ground plate 36. As an example, a choke-slot ground plane and monopole antenna system operating in the frequency of 14.2 gigahertz (wavelength ($\lambda$)=0.831 inches and $\lambda/4$=0.207 inches) would have a monopole antenna 44 having a height dimension C of 0.207 inches, a groove depth dimension D of 0.207 inches, a groove width dimension E of 0.207 inches, an overall diameter dimension G of 2.262 inches, and an inside diameter dimension H for the bore 40 of 0.700 inches (assuming a jack diameter dimension I of 0.215 inches).

Figure 4A:
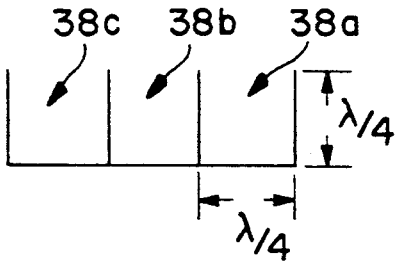
FIGS. 4*a–d* are schematic views of several various configurations of the choke-slot grooves employed in the present invention.
Figure 4B:
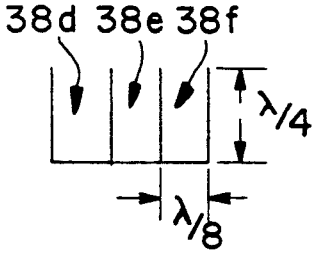
Figure 4C:
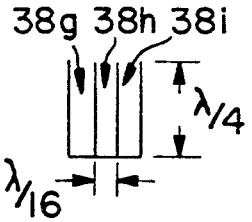
Figure 4D:
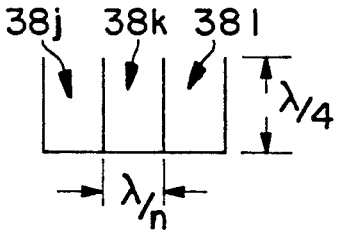

FIGS. 4*a–d* illustrate that several variations of grooves 38*a–c* are possible. FIG. 4*a* shows grooves 38*a–c* having a groove depth dimension D of $\lambda/4$ and a groove width dimension E of $\lambda/4$. FIG. 4*b* shows grooves 38*a–c* having a groove depth dimension D of $\lambda/4$ and a groove width dimension E of $\lambda/8$. FIG. 4*c* shows grooves 38*a–c* having a groove depth dimension D of $\lambda/4$ and a groove width dimension E of $\lambda/16$. FIG. 4*d* shows grooves 38*a–c* having a groove depth dimension D of $\lambda/4$ and a groove width dimension E shown generally as $\lambda/n$, where n is any whole number from 4 to a practical limit of approximately 20.

Figure 5A:
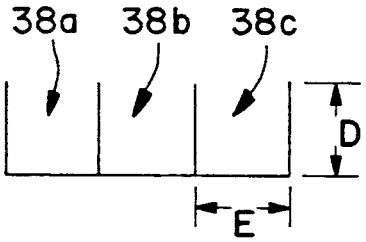
FIGS. 5*a* and 5*b* are schematic views of an equivalent choke-slot groove containing air or a dielectric material, respectively, and in accordance with one embodiment of the present invention.
Figure 5B:
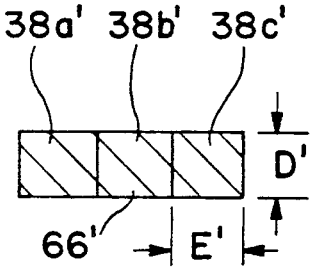

FIGS. 5*a* and 5*b* illustrate that the grooves may be loaded with a dielectric material to reduce the overall groove size where space is limited. FIG. 5*a* shows grooves 38*a–c* defining an interior area 66 which is filled with air. Air has a dielectric constant of one ($E_r$=1). This configuration for example yields a groove depth dimension D of one inch and a groove width dimension E of one inch. The physical dimension of one inch being used for comparative purposes in this illustration. FIG. 5*b* shows grooves 38*a'–c'* defining an interior space 66' filled with a dielectric material 68. If, for example, the dielectric material 68 is TEFLON ($E_r$=2.1), then the groove depth dimension D' would equal 0.69 inches and the groove width dimension E, would equal 0.69 inches. The reduction of physical space requirements for grooves 38*a'–c'* is due to the fact that electromagnetic waves travel slower in dielectric materials than air and therefore the effective electrical dimension of the groove is the same as the unloaded grooves from the perspective of the electromagnetic radiation.

Figure 6:
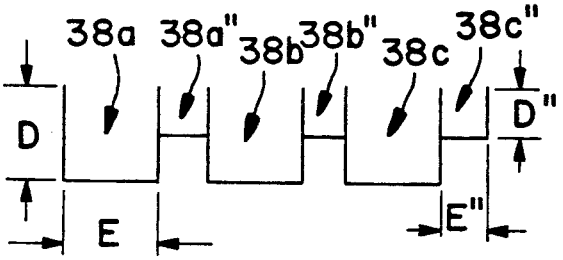
FIG. 6 is yet another schematical cross-sectional view of a multiple choke-slot configuration used for the purpose of extending the bandwidth of the ground plane.

FIG. 6 illustrates that the physical dimensions of the grooves 38*a–c* and 38*a''–c''* can be systematically varied for the purpose of extending the bandwidth of the ground plane. If, for example, the ground plane was required to be effective over the frequencies F1 and F2 having corresponding wavelengths $\lambda_1$ and $\lambda_2$, then the grooves 38*a–c* would have a groove depth dimension D of $\lambda_1/4$ and a groove width dimension E of $\lambda_1/4$, and grooves 38*a'–c''* would have a groove depth dimension D'' of $\lambda_2/4$ and a groove width dimension E'' of $\lambda_2/4$. The grooves 38*a–c* would operate to effect the first frequency, F1, and grooves 38*a''–c''* would operate to effect the second frequency, F2. It would be equivalent to have several variations according to this embodiment.

FIGS. 7*a* and 7*b* schematically illustrate that the ground plane may be formed on a ground plate having a frusto-conical shape. Specifically FIG. 7*a* shows a ground plane 34*a* formed on a frusto-conical ground plate 36*a*. FIG. 7*b* shows a ground plane 34*b* formed on a frusto-conical ground plane 36*b*. Ground plates 36*a* and 36*b* have the effect of tilting a radiation pattern down or up, respectively. The practical limits for this type of pattern control are approximately plus or minus 20° from horizontal.

FIGS. 8*a* and 8*b* diagrammatically show that the adjustable feed section 42 is operable to raise the monopole antenna 44. Specifically, FIG. 8*a* shows the monopole element in a flush position. The height dimension 70 is measured from the top plane 38*t*, defined by the top surfaces of the grooves 38*a–c*, and the shoulder 42*s* of the adjustable feed section 42. The height adjustment dimension J is 0.0 inches in the flush position. FIG. 8*b* shows the monopole antenna 44 being raised by the adjustable feed section 42 and having a height dimension J. Typically the height dimension J may vary between 0.0 inches and 0.5 inches. Negative height, or any height adjustment dimension J less than 0.0, increases mismatch losses to unacceptable levels. Excessive height negates the effectiveness of the ground planes pattern shaping ability.

The adjustable feed section 42 may be adjusted by sliding the adjustable feed section 42 along the bore 40. This sliding adjustment may be made by a variety of methods and means (not shown for the purposes of illustration), which includes but are not limited to manual adjustment, remote adjustment, and motorized adjustment. The effect of raising the monopole 44 lowers the beam peak towards the horizon. Lowering the monopole 44 pushes the beam peak up towards the zenith.

FIGS. 9*a* and 9*b* diagrammatically illustrate the method of operation of a ground plane and monopole according to conventional design and a choke-slot ground plane and monopole antenna system according to the present invention. FIG. 9*a* shows a conventional ground plane and monopole antenna system 74 emitting two exemplary waves 76*a* and 76*b* from the monopole antenna 78. The poor radiation pattern generated by antenna system 74 is due to the specular reflection at point 80 from the conventional ground plane 82. In addition, waves 76*c–e* are generated due to the edge effects of a conventional ground plane 82. Due to the superposition of these exemplary waves, the radiation pattern is varied and rough. In sharp contrast, FIG. 9*b* illustrates the principle of operation for a choke-slot ground plane and antenna system 30 emitting exemplary waves 76*f* and 76*g*. The capacitative field generated on the ground plane 34 cancels the specular reflection, edge effects, and results in a higher beam pointing angle, a narrower beam shape, a smoother pattern and less energy appearing below the ground plane due to edge effects.

Figure 10:
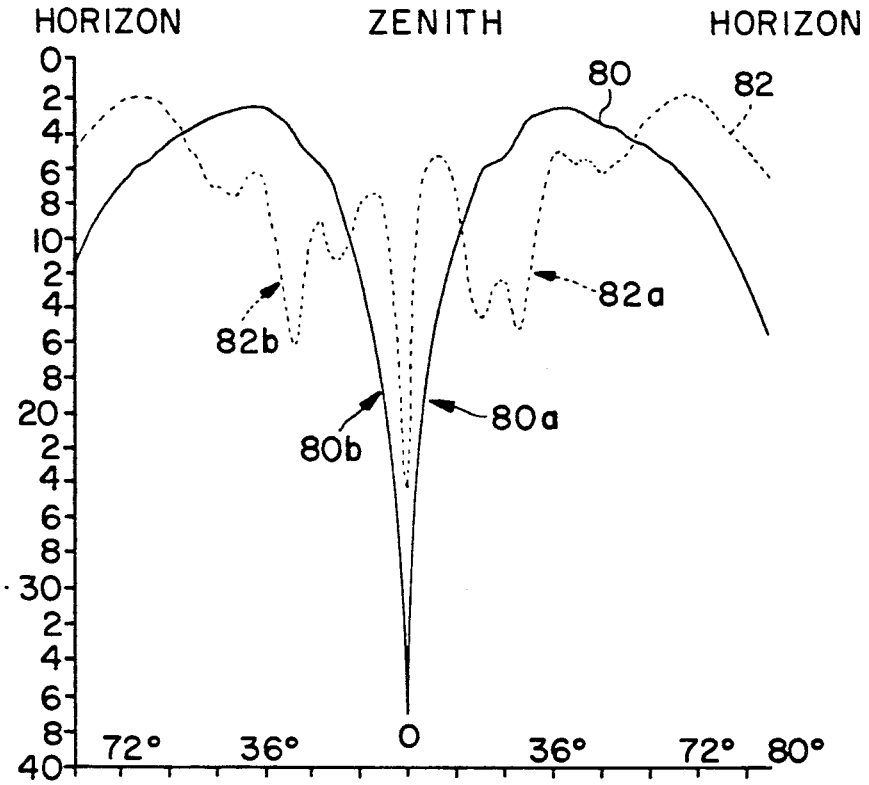
FIG. 10 is a graph showing the radiation pattern of a ground plane and monopole antenna system in accordance with the prior art and a radiation pattern of the choke-slot ground plane and monopole antenna system in accordance with one embodiment of the present invention.
Figure 11:
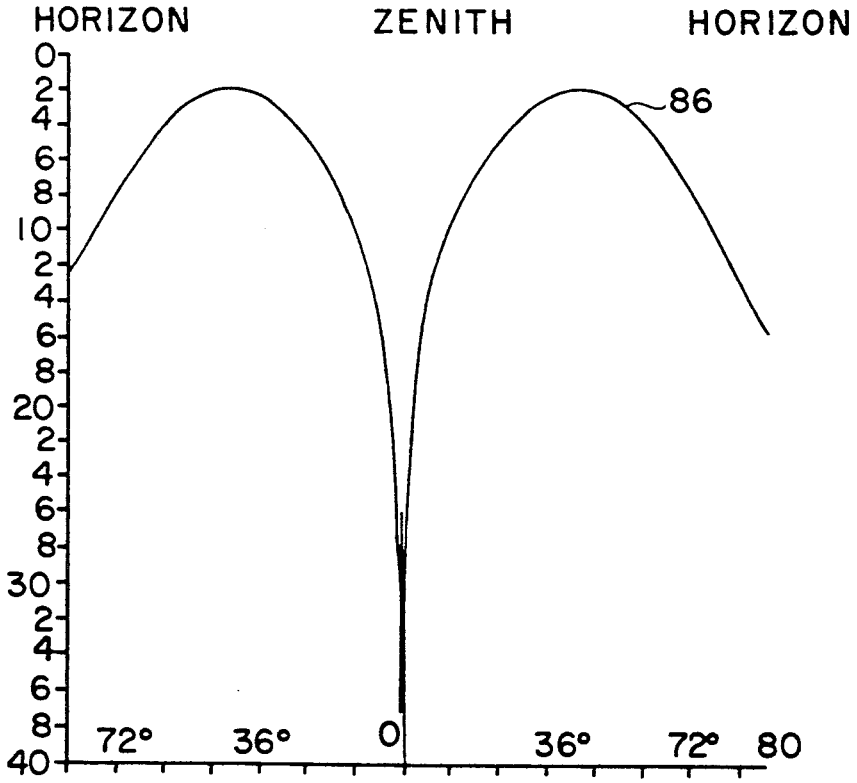
FIG. 11 is a graph showing the radiation pattern of a choke-slot ground plane and antenna system having six chokes.

FIG. 10 is a graph of the radiation patterns generated by a conventional ground plane and antenna system and a choke-slot ground plane and monopole antenna system in accordance with the present invention. Solid line 80 represents the amplitude of the radiation pattern generated by the present invention as a function of angle measured from the ground plane 34 to the monopole antenna 44 for a three choke ground plane and flush monopole antenna. The noticeable features of solid line 80 include: two symmetrical lobes 80*a* and 80*b*, a smooth distributed shape, and symmetrical peaks located at approximately 39°. In sharp contrast the dashed line 82 for the conventional ground plane and monopole antenna has undesirable features which include: non-symmetrical lobes 82*a* and 82*b*, spurious energy distribution, and peaks that occur at approximately 68°. FIGS. 11 and 12 show a radiation pattern for a six choke ground plane with a flush mounted monopole and a raised monopole respectively. Solid line 86 of FIG. 11 illustrates that a six choke embodiment has an even smoother distribution and a peak located at approximately 46°. FIG. 12 having solid line 90 illustrates that by raising the adjustable feed section 0.10 inches yields a higher indicated pointing angle of approximately 52°, which is closer to the horizon.

The benefits associated with the choke-slot ground plane and monopole antenna system can be summarized as follows:

1. A smooth and adjustable radiation pattern;
2. A compact antenna system with high isolation below the ground plane; and
3. A wide variety of choke-slot ground plane design options capable of being utilized in high power military jamming operations and commercial and mobile communication application.

Although the invention has been described with particular reference to certain preferred embodiments thereof, variations and modification can be effected within the spirit and scope of the following claims.

I claim:

1. An antenna system, comprising:
a monopole antenna;
a ground plate having a plurality of concentric annular grooves; and
means for attaching said monopole antenna to said ground plate.

2. The antenna system of claim 1, wherein said monopole antenna is perpendicular to said ground plate.

3. The antenna system of claim 1, wherein said attaching means is located central to said plurality of concentric annular grooves.

4. The antenna system of claim 1, wherein said monopole antenna has an operating wavelength, each said groove has a depth of ¼ of the monopole operating wavelength, and each said groove has a width of a whole fraction of the monopole operating wavelength.

5. The antenna system of claim 4, wherein each said groove has a width of ⅛ the monopole operating wavelength.

6. The antenna system of claim 4, wherein each said groove has a width of 1/16 the monopole operating wavelength.

7. The antenna system of claim 1, wherein each said groove is filled with a dielectric material.

8. The antenna system of claim 7, wherein each said groove has a width of ¼ the monopole operating wavelength.

9. The antenna system of claim 1, wherein said plurality of grooves have top surfaces which form a top plane and said attachment means is adjustable over a range of 0.0 inches to 0.5 inches above said top plane.

10. An antenna system, comprising:

a monopole antenna;

a ground plate having a plurality of closed grooves, said grooves having a common axis; and moving means, insulating said monopole antenna and ground plate, for moving said monopole along said common axis.

11. The antenna system of claim 10, wherein said closed grooves are concentric and substantially circular.

12. The antenna system of claim 10, wherein said moving means includes an adjustable feed section, said feed section has a body having a central bore and having an annular surface, said annular surface forming an angle with a plane normal to said common axis.

13. The antenna system of claim 10, wherein the monopole antenna is operable over wavelengths, $\lambda_a$ and $\lambda_b$, wherein said closed grooves have a series of widths and depths corresponding to said wavelengths, said width and said depth for a first-type groove being $\lambda_a/n$ and $\lambda_a/4$, respectively, said width and said depth for a second-type groove being $\lambda_b/n$ and $\lambda_b/4$, respectively, said series having alternating first and second-types grooves, and where n is an integer and whereby the ground plane has an extended operating bandwidth.

14. An antenna system, comprising:

a monopole antenna;

a ground plate having a frusto-conical shape;

a plurality of concentric annular grooves formed on said ground plate; and means for movably attaching said monopole antenna to said ground plate.

15. The antenna system of claim 14, wherein the ground plate, the plurality of concentric annular grooves, and the monopole antenna have a common axis.

16. The antenna system of claim 14, wherein the frusto-conical shaped ground plate slopes upwardly toward the monopole antenna.

17. The antenna system of claim 14, wherein the frusto-conical shaped ground plate slopes downwardly from the monopole antenna.

* * * * *